US006711096B1

(12) United States Patent
Benjamin

(10) Patent No.: US 6,711,096 B1
(45) Date of Patent: Mar. 23, 2004

(54) SHAPED PIEZOELECTRIC COMPOSITE ARRAY

(75) Inventor: Kim C. Benjamin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/241,380

(22) Filed: Sep. 11, 2002

(51) Int. Cl.[7] ..... H04R 17/00

(52) U.S. Cl. ..... 367/162; 367/153; 367/157; 310/337; 310/800

(58) Field of Search ..... 367/157, 153, 367/162, 176; 310/800, 327, 340, 367, 337

(56) References Cited

U.S. PATENT DOCUMENTS 4,731,763 A * 3/1988 Wagner ..... 367/153
4,748,366 A * 5/1988 Taylor ..... 310/800
4,786,837 A * 11/1988 Kalnin et al. ..... 310/800
4,843,275 A * 6/1989 Radice ..... 310/334
5,367,501 A * 11/1994 Kelly et al. ..... 367/157

* cited by examiner

*Primary Examiner*—Ian J. Lobo
(74) *Attorney, Agent, or Firm*—James M. Kasischke; Michael F. Oglo; Jean-Paul A. Nasser

(57) ABSTRACT

An underwater acoustic transducer includes a set of formed substrates of piezoelectric polymer composite, the formed substrates having at least a first and second surface. Conductive electrodes are deposited on the first and second sides of the formed substrates. One surface of the substrate is bonded to an acoustically absorptive backing material. Either surface can be made to conform to a singly or doubly curved geometry. Electrodes deposited on these substrates may be continuous to form a single transducer element, or segmented to form sub-arrays of transducer elements.

7 Claims, 2 Drawing Sheets

SHAPED PIEZOELECTRIC COMPOSITE ARRAY

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to a rugged broad band underwater acoustic transducer element for conformal array applications.

More particularly, the invention relates to a shaped 1–3 piezocomposite sensor.

(2) Description of the Prior Art

Currently there is a need for broadband conformal acoustic arrays for various SONAR applications.

The following patents, for example, disclose piezoelectric transducer elements, but do not disclose a conformal application of piezoelectric composite transducer elements, or the conformal arrays of the same.

U.S. Pat. No. 5,950,291 to Gentilman et al.;

U.S. Pat. No. 5,964,175 to Sirmalis et al.;

U.S. Pat. No. 6,255,761 to Benjamin;

U.S. Pat. No. 6,232,702 to Newnham et al.; and

U.S. patent application Ser. No. 09/968,396 to Benjamin.

Specifically, the patent to Gentilman et al. discloses methods for fabricating a conformable composite acoustic transducer panel including a conformable composite-body having upper and lower planar faces and upper and lower thin, flexible electrodes bonded to the upper and lower faces, respectively. The composite body includes an array of individual piezoelectric or electrostrictive ceramic elements extending normal to the upper and lower faces and through the composite body from the upper face to the lower face to electrically contact the electrodes. Stiff integral faceplates are bonded to the side surfaces of the elements at their upper and lower ends. Alternatively, a conformable, stiff, voided polymer matrix is bonded to the element sides over their entire length. Flexible circuit boards may be bonded to the electrodes to provide electrical contact thereto.

The patent to Sirmalis et al. discloses a system for attaching one or more unmanned, hydrodynamically shaped, autonomous, undersea platforms to the bow of a submarine. An array of depressions, each matching the shape of the platforms, is provided in the bow of the submarine, equally spaced about the circumference of the submarine. Once seated in the depressions and attached to the submarine, the platforms provide a smooth, hydrodynamic shape to the bow of the submarine. Additionally, conformal arrays on the platforms mate with conformal arrays on the bow of the submarine to form a continuous conformal array and the platforms' weapons systems provide the submarine with forward deployed weapons when the platforms are attached. A platform is launched by detaching it from the submarine bow and raising the leading edge of the platform slightly into the water flow around the bow. Hydrodynamic forces lift the platform away from the submarine for an acoustically quiet launch.

Newnham et al. discloses an electroactive device including an electroactive ceramic annular substrate having a pair of opposed planar annular surfaces, a hollowed interior region and a thickness aspect. A first cap having a concave shape that extends into the hollowed interior region includes a rim portion, bounding the hollowed interior region, and joined to a first one of the planar surfaces. A second cap having a concave shape that extends into the hollowed interior region includes a rim portion, bounding the hollowed interior region, and joined to a second one of the planar surfaces. A potential measured across the ceramic substrate enables a field change in the ceramic substrate to be sensed, the field change caused by flexure of the ceramic substrate as a result of a pressure applied to the first and second caps.

U.S. Pat. No. 6,255,761 to Benjamin provides a piezoelectric composite transducer and method for making the same. A block of piezoelectric material has a common base and a plurality of uniform-length rods extending from the common base in a parallel spaced-apart fashion to define an array. A first surface region is defined at outboard ends of the rods and a side region is defined about the periphery of the array. Electric conductors extend through the side region, are routed parallel to the first surface region, and are then led substantially parallel to the rods to the first surface region. Spaces between the rods are filled up to the first surface region with a viscoeleastic material. The common base of the block is then removed such that a second surface region parallel and opposite the first surface region is defined. Electrodes are deposited at the first surface region to be in contact with the rods and in electrical contact with the electric conductors. A ground electrode is deposited at the second surface region to be in contact with the rods. The resulting piezoelectric composite transducer can be heated and shaped to conform to complex curves.

U.S. patent application Ser. No. 09/968,396 to Benjamin provides that an ultrasonic sparse imaging array includes a substrate of an acoustically absorptive material, through which extends a multiplicity of holes. Adhesive sheets, having selectively conductive regions, are fixed to a first side of the substrate, and are each disposed over a first end of one of the holes. Plano-convex shaped transducer elements, having a wide acoustic field of view, are disposed on each of the sheets, each of the sheets serving as a positive electrode and providing a mechanical and electrical connection between the substrate and a multiplicity of transducer elements. Plating is fixed to the first side of the substrate and covers each of the transducer elements and comprises a negative electrode. A conductive epoxy fills each of the holes and a power source is in electrical communication with the negative electrode.

It should be understood that the present invention would in fact enhance the functionality of the above patents by providing a transducer fabrication with conformal array applications that is low in cost and provides a wide bandwidth.

SUMMARY OF THE INVENTION

Therefore it is an object of this invention to provide a broadband transducer element.

Another object of this invention is to provide a broadband transducer element of a shaped piezoelectric polymer composite material.

Still another object of this invention is to provide a broadband transducer element of a shaped composite material and having multi-element sub-arrays.

A still further object of the invention is to provide a broadband transducer element of a shaped composite material in which the shape of the composite material conforms to a given geometry.

Yet another object of this invention is to provide a broadband transducer element having plural shaped composite elements.

In accordance with one aspect of this invention, there is provided a composite transducer having a formed substrate of a piezoelectric polymer composite material, the formed substrate including at least a first and second surface. Conductive electrodes are deposited on the first and second sides of the formed substrate. One side of the formed substrate is bonded to an acoustically absorptive backing material whereas the other side conforms to any given singly or double curved geometry.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to a rugged broadband transducer element for conformal array applications and the construction thereof. The current invention introduces a class of transducer elements that are machined from solid blocks of piezoelectric polymer composite material and shaped to have conformal surfaces. The invention illustrates the use of both singly and doubly curved single elements as well as multi-element sub-arrays using the singly and doubly curved elements. These sensors may be arranged to comprise a conformal underwater acoustic array for SONAR applications.

FIGS. 1 through 4 illustrate some of the simple geometric shapes possible and their associated mounting arrangements for conformal array applications. It will be appreciated that any arbitrary surface geometry is possible using numerical controlled machining techniques, and the invention is therefore not limited to the examples illustrated here in FIGS. 1 through 4.

Figure 1:
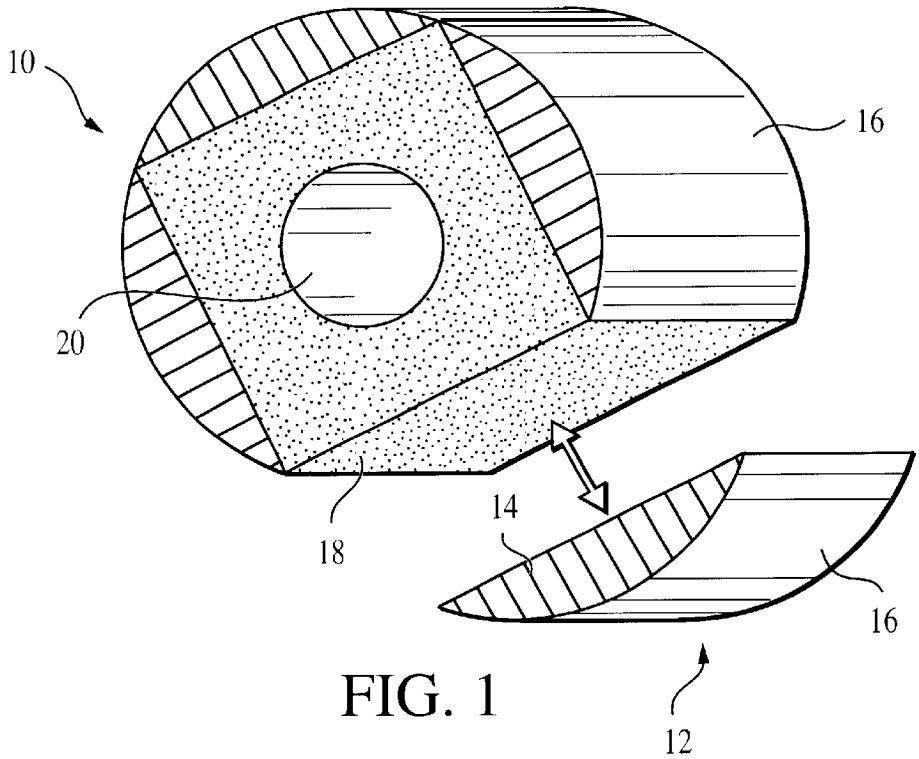
FIG. 1 is a perspective, sectional, and partially broken-away view of a first mounting arrangement of conformed transducer elements according to the present invention.

Referring first to FIG. 1, a four element cylindrical array 10 is shown. The array 10 includes four singly curved composite transducer elements 12. As known in the art, the singly curved transducer elements 12 are formed of a piezoelectric polymer composite material shaped and/or machined to have an outer surface radius equal to the desired cylindrical geometry. Each of the piezoelectric material pieces 14 includes an outer electrode surface 16 formed thereon. The piezoelectric composite transducer elements 12 are mounted to a solid backing material 18 that has been machined to accept the four shaped elements 12. The backing material 18 may be constructed to have at least one cavity 20 for cabling transducer signals to sonar system electronics (not shown). The element electrode surfaces 16 may be formed using techniques currently known in the art such as copper plating and the like.

It should be understood that the four composite transducer elements 12 could be more or less in number according to a desired end use. The number of elements is given by way of example only.

Figure 2:
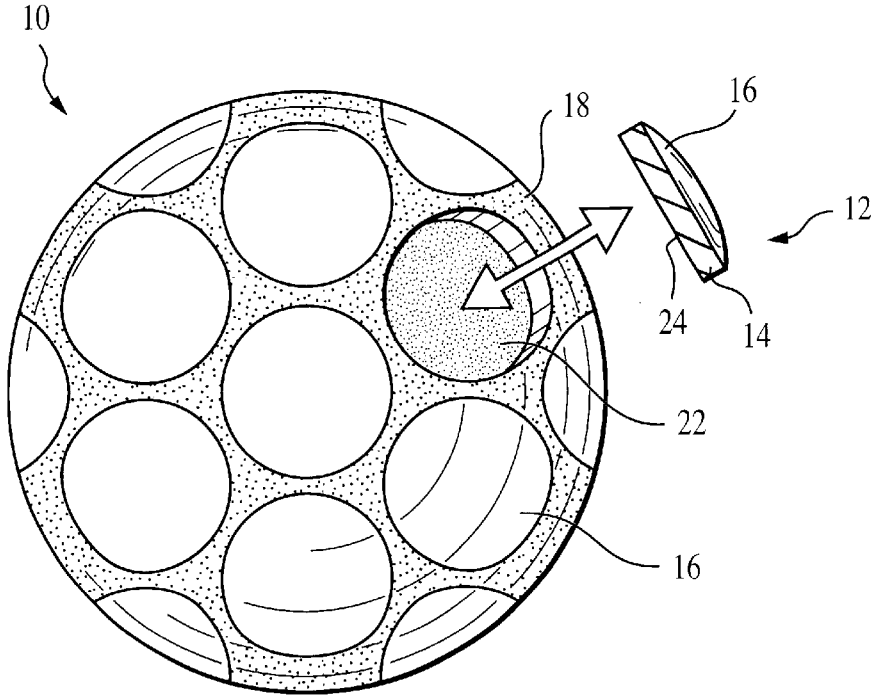
FIG. 2 is a perspective and partially broken-away view of a second mounting arrangement of conformed transducer elements according to the present invention.

FIGS. 2, 3 and 4 show other possible multi-element conformal configurations of piezoelectric composite transducer elements 12. In FIG. 2, a doubly curved spherical radiating aperture is approximated with the formed piezoelectric polymer composite substrate 14 and the backing material 18. The sphere shaped backing material 18 is recessed as shown at 22 to receive one side 24 of the shaped piezoelectric polymer composite transducer element 12.

Figure 3A:
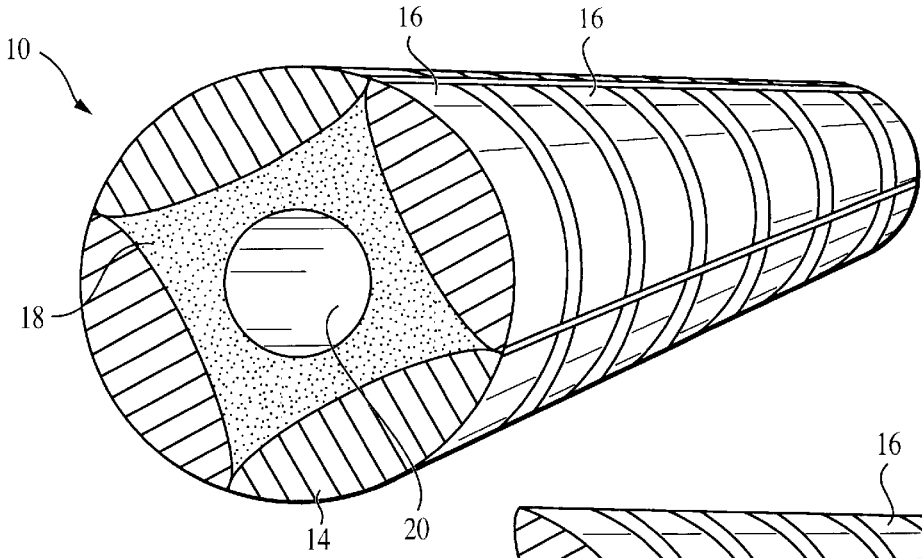
FIG. 3A is a perspective and sectional view of conical multi-element sub-arrays according to the present invention.
Figure 3B:
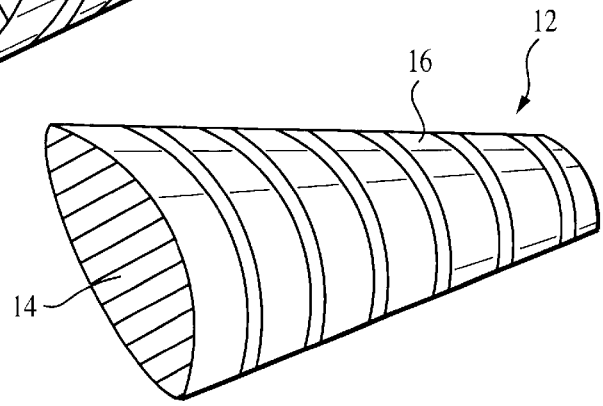
FIG. 3B is a perspective view of a multi-element sub-array of FIG. 3A.

FIGS. 3 and 4 show multi-element sub-arrays formed by delineating electrode areas into arbitrary sub-regions as shown. In particular and referring first to FIG. 3A, corresponding reference numerals refer to similar elements described in connection with FIG. 1. Here, the piezocomposite transducer element 12 is formed into a conical shape and the outer electrode surfaces 16 are spaced along a length of the transducer element 12 on an outer convex surface thereof. The backing material 18 is formed to accept the opposing convex projection of each of the shaped piezocomposite transducers 12. FIG. 3B illustrates the actual shape of each peizocomposite subarray transducer element 12 in FIG. 3A. The result is a multi-element array having a controllable composite aperture.

Figure 4A:
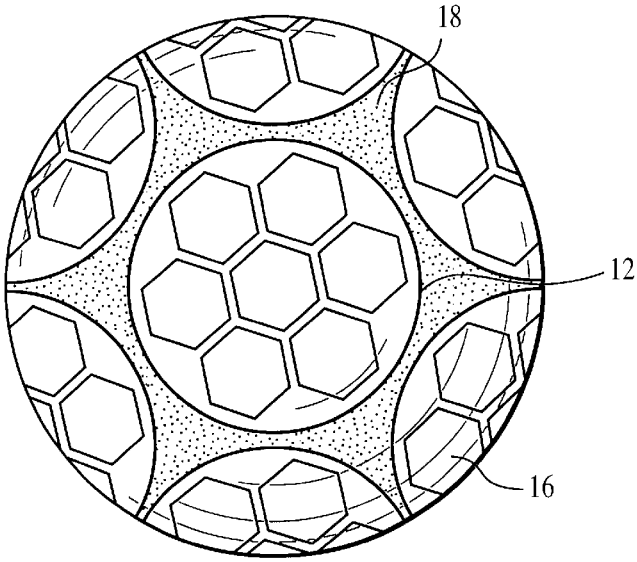
FIG. 4A is a perspective view of a spherical multi-element array according to the present invention.
Figure 4B:
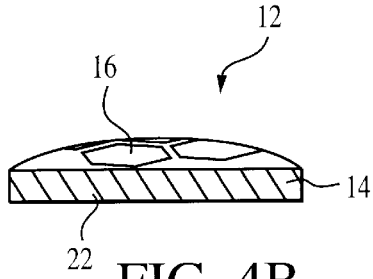
FIG. 4B is a side view of a multi-element sub-array of FIG. 4A.

Turning now to FIGS. 4A and 4B, there is yet another example of conformally applied piezoelectric composite transducer elements 12 arranged in spherical multi-element sub-arrays. It can be seen that the electrode surfaces 16 are arranged on the shaped piezoelectric bases 14 in sub-array patterns.

While only certain examples have been given, it will be understood that the present invention includes within its scope any of the numerous possible singly or doubly curved surface shapes that can be post machined from rectangular or circular blocks of piezoelectric polymer composite material using numerical control grinding techniques. This thicker material is applicable to broadband, medium-frequency range acoustic transducer elements. Depending on the piezoceramic composition, the 1-inch thick material half wave resonance frequency is approximately 60–75 kHz with a low mechanical quality factor ($Q_m$).

Accordingly, with the advent of thick (~1 inch) piezoelectric composites, transducers can be constructed to operate in the mid frequency range (~60+/−30 kHz). By simply matching solid blocks of the subject material, numerous singly and doubly curved element surfaces can be formed. Using standard numerical controlled grinding techniques, just about any surface geometry of interest may be realized. These transducer elements, which would operate over a broad frequency range centered about 60 kHz or greater, are mountable onto backing structures possessing the same contour geometry such that the active and inactive regions combine to give a smooth conformal surface for hydrodynamic applications.

In view of the above detailed description, it is anticipated that the invention herein will have far reaching applications other than those described herein.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An underwater acoustic transducer array comprising:

a shaped acoustically absorptive backing material;

a plurality of formed substrate sections positioned on said backing material and formed from a piezoelectric polymer, each section having a first surface and a second surface;

at least one first conductive electrode positioned on said first surface of each section; and at least one second conductive electrode positioned on said second surface of each section, said first conductive electrode, said second conductive electrode, and said formed substrate section between said first and second conductive electrodes forming one transducer element of the array;

said shaped acoustically absorptive backing material is a cylinder having flat, longitudinal surface cutouts formed thereon; and said plurality of formed substrate sections being formed as longitudinal surface sections wherein said first surface combines with an outer surface of said shaped acoustically absorptive backing material to form a cylinder, and said second surface being positioned on said longitudinal surface cutouts of said backing material.

2. The device of claim 1 wherein said backing material has a cavity formed therein and further comprising cabling positioned within said backing material cavity.

3. The device of claim 2 wherein said first conductive electrode comprises a plurality of first conductive electrodes in a longitudinally segmented configuration.

4. An underwater acoustic transducer array comprising:

a shaped acoustically absorptive backing material;

a plurality of formed substrate sections positioned on said backing material and formed from a piezoelectric polymer, each section having a first surface and a second surface;

a plurality of first conductive electrodes positioned on said first surface of each section in a patterned hexagonally segmented configuration; and at least one second conductive electrode positioned on said second surface of each section, said first conductive electrodes, said second conductive electrode, and said formed substrate section between said first and second conductive electrodes forming one transducer element of the array;

said shaped acoustically absorptive backing material is a sphere having circular surface cutouts formed thereon; and said plurality of formed substrate sections being formed as spherical surface sections wherein said first surface combines with an outer surface of said shaped acoustically absorptive backing material to form a sphere, and said second surface being positioned on said circular surface cutouts of said backing material.

5. An underwater acoustic transducer array comprising:

a shaped acoustically absorptive backing material;

a plurality of formed substrate sections positioned on said backing material and formed from a piezoelectric polymer, each section having a first surface and a second surface;

at least one first conductive electrode positioned on said first surface of each section; and at least one second conductive electrode positioned on said second surface of each section, said first conductive electrode, said second conductive electrode, and said formed substrate section between said first and second conductive electrodes forming one transducer element of the array;

said shaped acoustically absorptive backing material is a longitudinally extending shape having arcuate, longitudinal surface cutouts formed thereon; and said plurality of formed substrate sections being formed as longitudinal surface sections wherein adjacent said first surfaces of said formed substrate sections combine to form a cylinder, said second surface being curved in conformance with said arcuate, longitudinal surface cutouts of said backing material and positioned on said arcuate, longitudinal surface cutouts of said backing material.

6. The device of claim 5 wherein said backing material has a cavity formed therein and further comprising cabling positioned within said backing material cavity.

7. The device of claim 6 wherein said first conductive electrode comprises a plurality of first conductive electrodes in a longitudinally segmented configuration.

* * * * *